United States Patent [19]

Petrushka

[11] Patent Number: 5,067,552

[45] Date of Patent: Nov. 26, 1991

[54] SHROUDING FOR TOP POURING OF INGOTS

[75] Inventor: Robert G. Petrushka, Brecksville, Ohio

[73] Assignee: LTV Steel Company, Inc., Cleveland, Ohio

[21] Appl. No.: 385,773

[22] Filed: Jul. 26, 1989

[51] Int. Cl.[5] ..... B22D 23/00

[52] U.S. Cl. ..... 164/259; 164/66.1; 222/603; 266/207

[58] Field of Search ..... 164/259, 415, 66.1, 164/475; 222/603, 606, 607; 266/207, 217, 236

[56] References Cited

U.S. PATENT DOCUMENTS

| | | | |
|---|---|---|---|
| 2,741,814 | 4/1956 | Hazlett | 222/607 X |
| 2,905,989 | 9/1959 | Black | 164/415 X |
| 3,174,200 | 3/1965 | Keel et al. | 164/66.1 |
| 3,265,348 | 8/1966 | Sylvester | 164/259 X |
| 3,402,757 | 9/1968 | Halliday | 164/475 |
| 3,439,735 | 4/1969 | Holmes | 164/259 |
| 3,482,621 | 12/1969 | Halliday | 164/415 X |
| 3,558,256 | 1/1971 | Bick et al. | 164/415 |
| 3,572,422 | 3/1971 | Lyman | 164/475 X |
| 3,616,843 | 11/1971 | Newhall et al. | 164/415 X |
| 3,705,672 | 12/1972 | Saxer | 222/606 |
| 3,756,305 | 9/1973 | Haussner | 164/415 X |
| 3,833,050 | 9/1974 | Kashuba et al. | 164/259 X |
| 3,908,734 | 9/1975 | Pollard | 164/415 X |
| 3,921,704 | 11/1975 | Tozaki | 164/415 |
| 3,963,224 | 6/1976 | Pollard | 266/207 |
| 3,991,813 | 11/1976 | Andersson et al. | 164/259 |
| 4,023,614 | 5/1977 | Pollard | 164/415 |
| 4,062,397 | 12/1978 | Cashdollar, Sr. | 164/415 |
| 4,084,799 | 4/1978 | Coward et al. | 164/415 X |
| 4,211,390 | 7/1980 | Poole et al. | 164/415 X |
| 4,218,048 | 8/1980 | Vanecek et al. | 266/236 |
| 4,270,595 | 6/1981 | Coward | 164/415 |
| 4,369,831 | 1/1983 | Hayashi | 164/415 |
| 4,381,102 | 4/1983 | King | 266/207 X |
| 4,429,816 | 2/1984 | Thrower | 222/603 |
| 4,480,770 | 11/1984 | Goursat et al. | 222/603 X |
| 4,519,438 | 5/1985 | Grosso et al. | 164/415 |
| 4,527,718 | 7/1975 | Kingston | 222/603 |
| 4,530,393 | 7/1985 | Rokop et al. | 164/415 |
| 4,565,239 | 1/1986 | Meier | 164/475 |
| 4,589,465 | 5/1986 | Gerding et al. | 164/259 X |
| 4,730,812 | 3/1988 | Mielke | 266/236 |
| 4,840,297 | 6/1989 | Weekley et al. | 164/337 X |

FOREIGN PATENT DOCUMENTS

| | | | |
|---|---|---|---|
| 2453631 | 5/1975 | Fed. Rep. of Germany | 164/415 |
| 2929500 | 1/1981 | Fed. Rep. of Germany | 164/415 |
| 56-59569 | 5/1981 | Japan | 164/259 |
| 60-49857 | 3/1985 | Japan | 164/5 |
| 899275 | 1/1982 | U.S.S.R. | 222/606 |
| 1034835 | 8/1983 | U.S.S.R. | 222/606 |
| 1047579 | 10/1983 | U.S.S.R. | 249/174 |

*Primary Examiner*—J. Reed Batten, Jr.

*Attorney, Agent, or Firm*—Watts, Hoffmann, Fisher & Heinke Co.

[57] ABSTRACT

The apparatus includes a generally cylindrical windscreen member attached to the bottom of a ladle with its axis generally vertical and concentric with a tap hole in the bottom of the ladle through which molten metal flows when released by a valve. An apertured cover plate is telescopically fitted over the windscreen. The cover plate is supported by a wire harness assembly coupled to the underside of the ladle for suspending the cover plate in a hanging relationship beneath the ladle. Lift line apparatus is provided for changing the elevation of the cover plate with respect to the ladle and windscreen in response to changes in the application of tension to the lift line. The cover plate is configured to rest upon, and form a seal with, the upper rim of an ingot mold when the cover plate is lowered while positioned above and aligned with the ingot mold. The windscreen and cover plate are made from a fibrous ceramic low density material to facilitate manual handling.

16 Claims, 5 Drawing Sheets

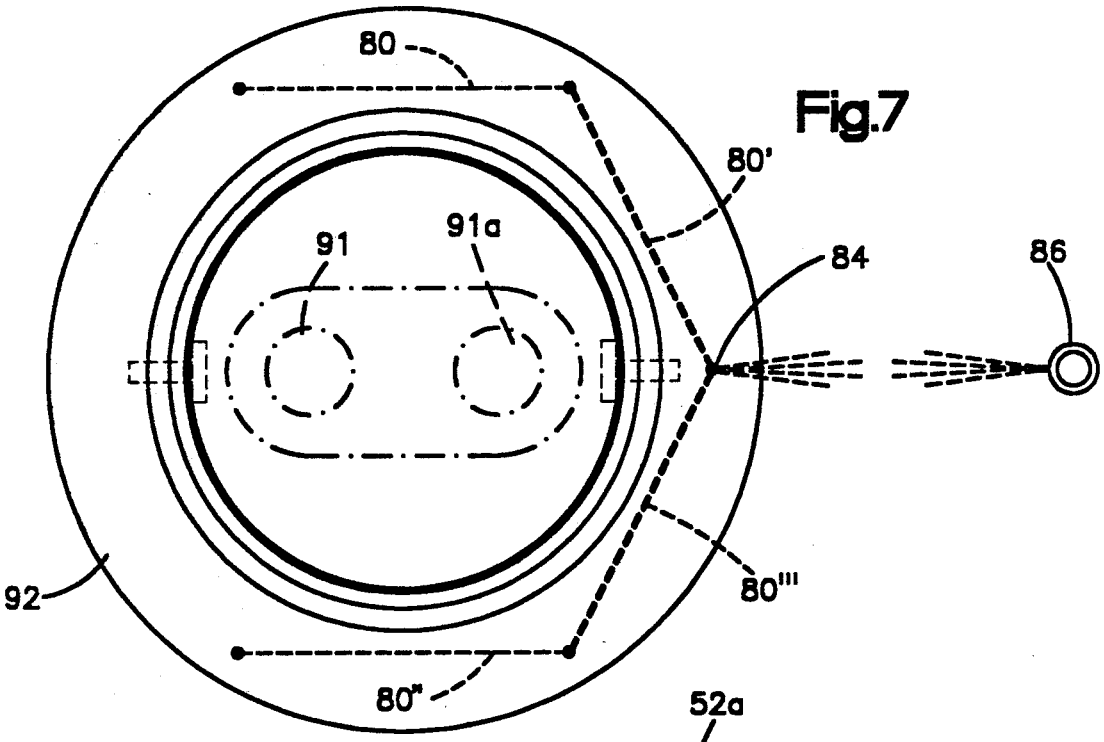
Fig.7
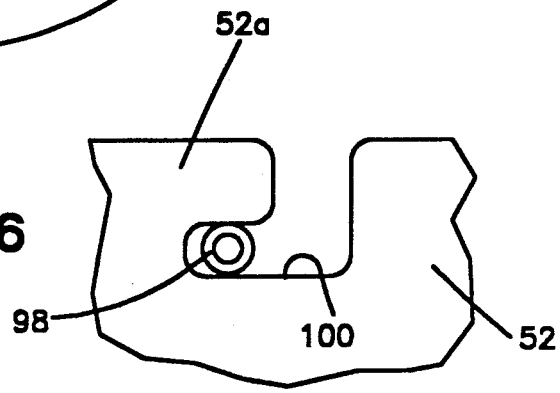
Fig.6
Fig.5
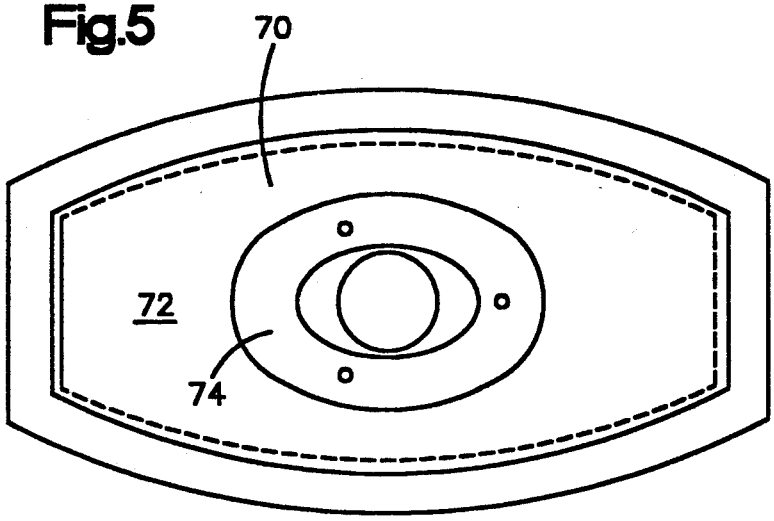

SHROUDING FOR TOP POURING OF INGOTS

BACKGROUND OF THE INVENTION

A. Technical Field

The present invention relates generally to metal processes and in particular to apparatus and method for shrouding a molten metal stream during a teeming, or molten metal pouring, operation.

B. Description of the Prior Art

In the making of metal, such as steel, refined molten metal is poured from a ladle to one or more ingot casting molds Each mold consisting of a bottom and an upright rectangular tubular wall section, can hold several (e.g. 15 to 24) tons of molten metal. After transferring the molten metal to a mold by pouring, the molten metal and the mold are allowed to cool, after which a solid ingot of metal is removed from the mold by lifting off the wall section The ingot is of a size and configuration which facilitates subsequent processing, or working, by other machinery into forms, such as rolled sheets, from which the metal can be further worked and/or cut to produce pieces of metal from which products can be made.

During a pouring, or "teeming" operation, a ladle, holding about 200 tons of molten metal and having at least one nozzle extending downwardly from its base or bottom, is moved by an overhead crane into a position with the nozzle aligned above the upper, or open, end of the mold, and then lowered into pouring position. A valve associated with the nozzle is opened to allow the molten metal to exit the bottom of the ladle by gravity and enter the mold. The molten metal thus fills the mold. When the mold is completely filled, the valve is closed to terminate the flow of molten metal out of the ladle. The ladle is then, sometimes after being raised up away from the top of the mold, translated a distance to align the nozzle with the top of the next mold to be filled. The ladle is then (if it was raised) relowered to position the nozzle near the top of the mold.

In instances in which the molten metal is "killed" steel, (i.e. completely deoxidized) it is imperative for obtaining high quality steel that the molten metal stream leaving the ladle nozzle be isolated or shrouded from atmospheric air as much as possible, in order to prevent re-oxidation of the metal. If the molten metal stream is exposed to the atmosphere, oxygen is drawn into the stream and produces reoxidation products, often termed "inclusions" in the cast material which lower the overall quality of the cast. Of particular concern are alumina inclusions, which constitute an extremely hard substance which interferes with subsequent working of the steel. Many applications require high grade steel and it has been found that steel produced by prior art methods, in which the stream was poorly shrouded, was unacceptable.

In some applications, an inert gas such as argon is injected in the region around the lower portion of the molten stream to inhibit atmospheric air from contacting the stream. Also, inert gas is sometimes introduced into the lower portion of the mold as well. In some cases, chemical compounds, such as paraffin, are placed in the mold before pouring. These compounds react in the presence of the molten steel to emit gases which are intended to perform the same function as those gases introduced from the outside, such as the argon described above.

Sometimes, a perforated ring was provided extending about the molten stream and connected to a source of natural gas. The natural gas was discharged into the region of the lower portion of the stream and ignited. It was thought that the burning would reduce the amount of oxygen in the ambient atmosphere around the stream and thereby reduce re-oxidation. In practice, this procedure did little good.

Inert gases such as argon can be very expensive and it is important that the gas be confined as well as possible around the stream Attempts have been made to shroud the molten metal stream as it travels from the ladle into the mold. Other methods have been proposed for shrouding the interface between the ladle and the mold.

One such shrouding apparatus is described in U.S. Pat. No 4,589,465, issued on May 20, 1986, to Gerding, et al. and entitled "Top Pour Shroud", which patent is hereby expressly incorporated by reference.

The Gerding device included a steel plenum box affixed to the bottom of the ladle and surrounding the nozzle. When the nozzle was opened, the molten steel would drop by gravity through the box, essentially without touching it, and be deposited in the mold. The Gerding device also included a heavy steel hood defining a hole aligned with and forming a rough seal about the plenum box and through which the box could protrude. The hood was also coupled to the bottom of the ladle via a power operated mechanism which could raise and lower the cover plate with respect to the bottom of the ladle. When it was desired to top pour an ingot mold, the ladle, with the associated shrouding structure, would be moved such that the plenum box and nozzle were aligned with the central portion of the top opening of the ingot mold. The hood would then be lowered until it contacted the upper rim of the open top of the mold, providing another rough seal to keep the inert gas within the mold and within the plenum box with minimum leakage to the outside.

In order to facilitate this sealing function, the hood in the Gerding device was pivotable about only a single horizontal axis, and movable vertically. These degrees of freedom assisted in enabling the cover plate to better approximate a better seal about the top end of the mold than would be the case if it did not have this versatility.

While this apparatus was useful, particularly for top pouring small ingots, it exhibited significant problems when used in pouring larger ingots. For one thing, the Gerding apparatus was very heavy, expensive and complex. Such as, it was difficult to install on and remove from the ladle. Using this prior art arrangement, set-up and take-down time for the device was on the order of 20 to 25 minutes each way, and required two to three men, as well as the services of a crane and operator.

Set-up and take-down of the shrouding apparatus is necessary before and after each operation in which a filled ladle is completely emptied into a succession of about 8 ingot molds, the whole operation being termed a "pour". Typically, it is desired to achieve about several dozen "pours" per day. It can thus be seen that the time lost setting up and taking down the prior art apparatus significantly raises the cost of producing the steel.

Another problem with the prior art apparatus was that the hood, even though having two degrees of rotational freedom, sometimes did not effect a satisfactory degree of seal with the upper rim of the mold. This condition obtained because usually the upper rim of the mold is not completely level. Complicating the situation is the additional fact that the upper rim of the mold tends to become encrusted with an uneven residual deposit of cooled solid metal which forms a rough surface The hood of the prior art apparatus was not, often, sufficiently compliant to effect the quality or degree of sealing necessary for good shrouding.

Another technique for transferring molten metal from a ladle into an ingot mold is called "bottom pouring". In bottom pouring, a tall vertical conduit, sometimes called a "trumpet", communicates at a lower end with the bottom of several ingot molds. The trumpet extends upwardly beside the mold to an elevation somewhat higher than that of the upper rim of the mold. The ladle is positioned with its nozzle aligned with the upper end of the trumpet When the nozzle is opened and molten steel flows into the trumpet, the level of molten metal in the molds rises from the bottom, exposing only the upper surface of the rising column of molten metal to whatever gas may be present in the mold. There is less agitation and splashing of molten metal than in the case of top pouring, which generally reduces the vulnerability of the steel to degradation by contact with atmospheric gases.

While bottom pouring is a worthwhile technique to use where specifications call for very high purity steel, and a high degree of freedom from inclusions, bottom pouring is not considered advantageous for producing most grades of steel, due to its far higher cost when compared with top pouring It is estimated that, to accomplish one pour by bottom pouring techniques, costs several thousands of dollars more than top pouring without a shroud. The cost of top pouring an equivalent amount of steel is far less. For this reason, bottom pouring has not generally been used for any applications other than making extremely high quality, inclusion free and expensive steel.

It is an object of the present invention to provide a technique and apparatus for producing steel having a level of purity and freedom from inclusions rivaling that of the bottom pouring method, by the use of the much less expensive top pouring of ingot molds.

SUMMARY OF THE INVENTION

The disadvantages of the prior art are reduced or eliminated by the use of an apparatus for shrouding molten metal during a top pouring operation wherein molten metal is transferred from a vessel into an ingot mold having an upper opening defined by a rim. The apparatus includes a cover plate defining an aperture through which molten metal can be poured, and flexible line means extending between the cover plate and the vessel for hanging the cover plate in a location such that molten metal, when delivered from the vessel, passes through the aperture and falls into the mold. The cover plate is generally configured to substantially cover the opening of the mold when the cover plate is placed atop the rim.

A more specific aspect of the invention involves the flexible line means comprising a wire harness.

In accordance with a more specific aspect, the embodiment of the invention includes means coupled to the flexible line means for adjusting the elevation of the cover plate relative to the vessel. More specifically, the invention further includes lift line means coupled to the flexible line means for adjusting the elevation of the cover plate relative to the vessel in response to changes in tension applied to the lift line means.

A more specific embodiment of the invention includes a windscreen member attached to the underside of the vessel in a location through which molten metal flows when delivered from the vessel. The windscreen member is generally cylindrical in configuration and is telescopically fitted with respect to the aperture in the cover plate.

In accordance with a more specific aspect, the cover plate and windscreen are made of a low density, heat resistant, fibrous ceramic material.

The hanging of the cover plate beneath the vessel gives the cover plate sufficient compliance and freedom of movement, when lowered upon the upper rim of the ingot mold, to effect a better seal with the upper rim than was previously possible in the prior art, despite undulations and roughness of the upper rim due to cooled metal deposits, and despite deviations of the upper rim from level. The lift line means enables an operator to quickly and easily adjust the elevation of the cover plate with respect to the vessel and with respect to the upper rim of the mold. The vessel can be simply moved transversely in steps from one mold to the next, and shrouding can be effected by simply lowering the cover plate to contact the upper rim of the mold when the vessel and cover plate are aligned above a particular mold to be poured.

The fibrous ceramic low density composition of the cover plate facilitates manual raising and lowering of the cover plate by a single operator. This composition also facilitates handling of the windscreen and cover plate, which must be frequently changed during the course of a shift, and replaced with new windscreens and cover plates.

The shrouding apparatus, including the windscreen and the cover plate, are quite inexpensive, and add only a tiny fraction to the cost of top pouring without a shroud, an operation which, as pointed out above, is already much cheaper than the above described bottom pouring method.

This invention will be more completely understood by reference to the following specific descriptions, and to the drawings, in which:

BRIEF DESCRIPTION OF THE DRAWINGS

FIG. 5 is a plan view illustrating the spatial relation between a portion of the embodiment of the present invention and an ingot mold;

FIG. 6 is a detail view showing a portion of the apparatus of FIG. 4, and FIG. 7 is a plan view illustrating a detail of the invention embodiment of FIG. 4.

BEST MODE FOR CARRYING OUT THE INVENTION

Figure 1:
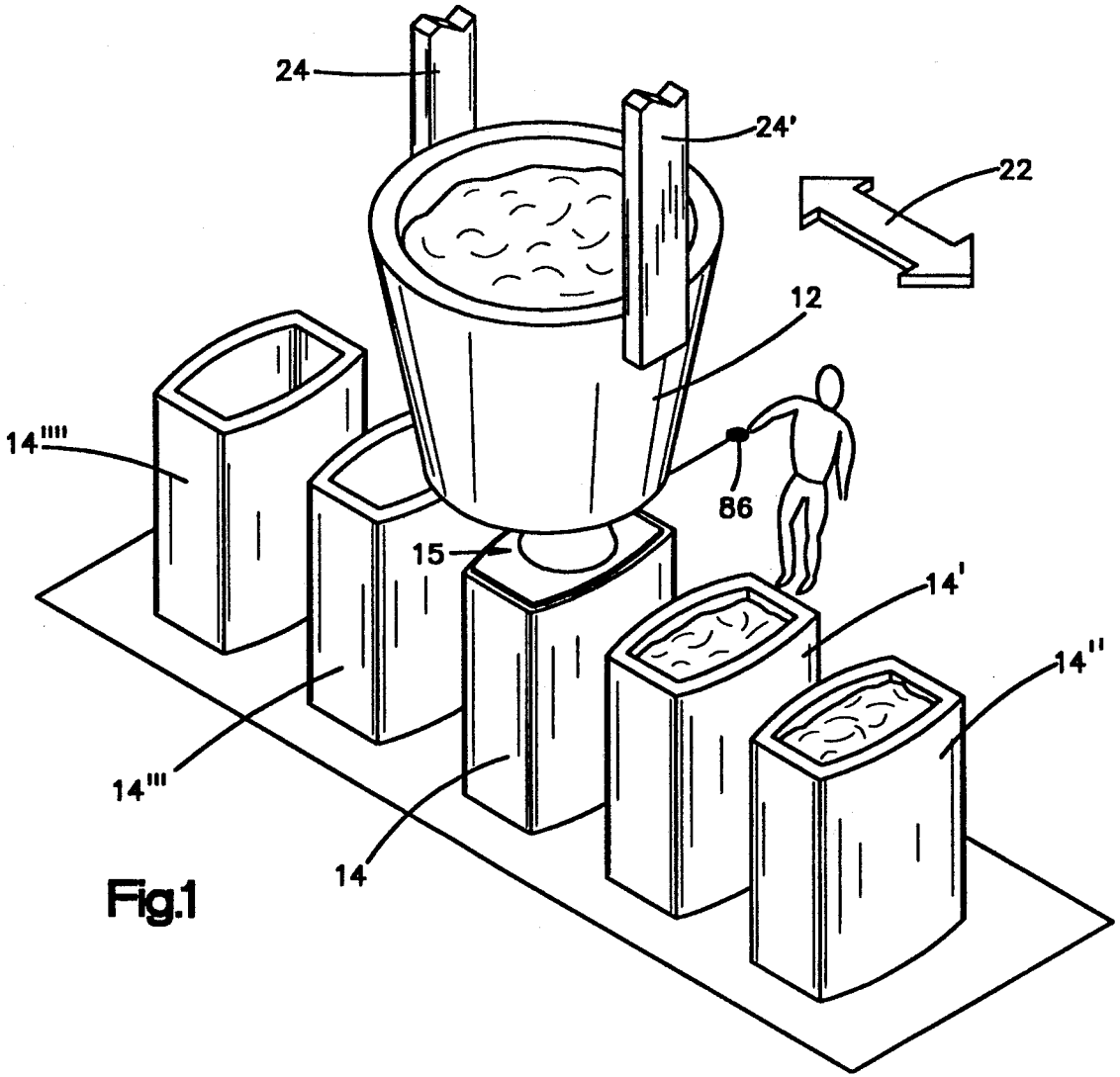
FIG. 1 is a pictorial view of an overall ingot top pouring operation and apparatus in which an embodiment of the present invention is incorporated.

FIG. 1 illustrates the overall construction and use of a shrouding apparatus embodying the present invention. The shrouding apparatus, is positioned between a ladle 12 and an ingot mold 14, and shields a molten metal stream 15 as it travels the gap defined by the space between the ladle and the mold. The shroud apparatus provides a closed chamber for confining a protective shroud of inert gas.

Figure 2:
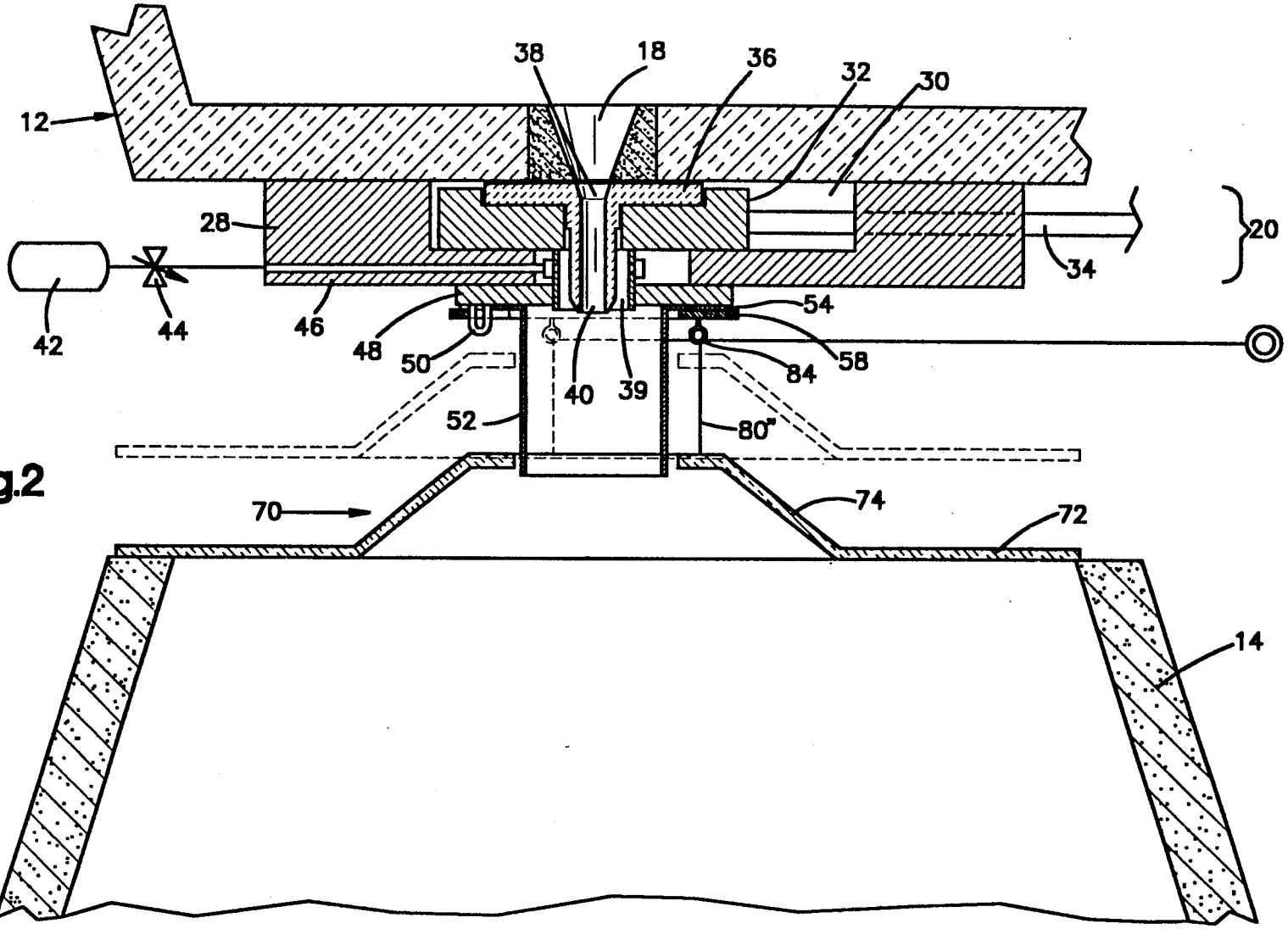
FIG. 2 is an elevational cross sectional view illustrating in detail a portion of the apparatus shown in FIG. 1.

The ladle 12 is conventional and comprises a very large open topped vessel lined with fire brick or other heat resistant material A tap hole 18 (see FIG. 2) formed in the base of the ladle provides for gravity discharge of the molten metal A nozzle or valve assembly 20 (FIG. 2) is mounted to the underside of the ladle 12 and in the illustrated embodiment, comprises a single nozzle assembly The nozzle assembly 20 may be either what is called a "rotary nozzle" (FIG. 4) or a "sliding gate" nozzle, the latter being shown in FIG. 2.

FIG. 1 illustrates a succession of five ingot molds suitable for top pouring of steel. Molds 14' and 14'' are illustrated as having already been filled with molten steel to await cooling and removal therefrom as steel ingots for further processing. Molds 14''' and 14'''' have yet to be filled with molten steel from the ladle 12.

The ladle 12 is supported by members 24, 24', which are in turn hung from a moveable crane (not shown). The crane moves the ladle in controlled fashion along a linear path generally indicated by the arrows 22. The ladle is thus moved transversely in increments to position it aligned with and above each of the succession of ingot molds.

A sliding gate nozzle 20, of known design, and illustrated in FIG. 2, includes a block member 28 which is fixed to the bottom of the ladle 12. The block member, in cooperation with the bottom of the ladle, defines a cavity 30 in which is located a slidable member 32. The member 32 can slide to the left and right, as indicated in FIG. 2, by actuation of a control lever 34 which extends from outside the block member to the inside of the cavity 30, in which it is mechanically coupled to the slidable member 32.

The slidable member 32 defines on its top surface a recess, and an aperture 38 having a vertical axis and extending through the member 32. Seated in the recess, and extending through the aperture 38, is a cylindrical sleeve 36 having an outwardly extending flange about its upper end. The sleeve is made of a refractory material, and is a known element often referred to as a "collector nozzle".

The collector nozzle 36 itself defines a cylindrical aperture 40 extending top to bottom through the collector nozzle. The block member 28 also defines an aperture 39, below the cavity 30, through which the collector nozzle 36 downwardly extends. The aperture 39 is sufficiently large to allow substantial movement of the collector nozzle to the right and to the left as shown in FIG. 2.

When the control lever 34 is moved to cause the slidable member to align the aperture 40 of the collector nozzle 36 with the tap hole 18, a continuous conduit is formed from the tap hole of the ladle through the entire nozzle assembly Molten steel from the ladle can then pass through the tap hole, and through the collector nozzle until it falls by gravity from the lower side of the nozzle assembly When the lever 34 is moved to cause the aperture 40 to move out of alignment with the tap hole, (movement to the right as shown in FIG. 2) the flow of molten metal from the ladle is terminated.

As mentioned above, the details of construction of a sliding gate nozzle are well known in the present art, and the above description is given only to assist those who are not conversant with this art.

One improvement of the present invention is embodied by a source 42 of inert gas, such as argon, which is controlled by a valve 44 to deliver argon through a conduit 46, into the region of an annulus surrounding the collector nozzle. This delivery of argon directly into the aperture 39 of the valve enhances the protection of the molten metal from ambient oxygen and nitrogen, which can combine or react with the molten metal to form undesirable compounds in the steel being poured.

If the argon were not injected, or introduced, at substantially this location, the motion of the falling molten metal stream would aspirate outside air into the region, which would degrade the metal. By introducing an inert gas in the annular region surrounding the collector nozzle, the aspiration of air is prevented. This feature of the invention provides a substantially cylindrical curtain of argon about the major portion of the collector nozzle.

In addition to introducing argon at the nozzle, as shown in FIG. 2, argon can also be introduced into the mold itself, as is known in the prior art. Additionally, prior art compounds reactive with the heat from the molten metal can also be included in the mold prior to pouring in order to supplement the emission of desirable protective shrouding gases in the region of exposed molten metal.

Figure 3:
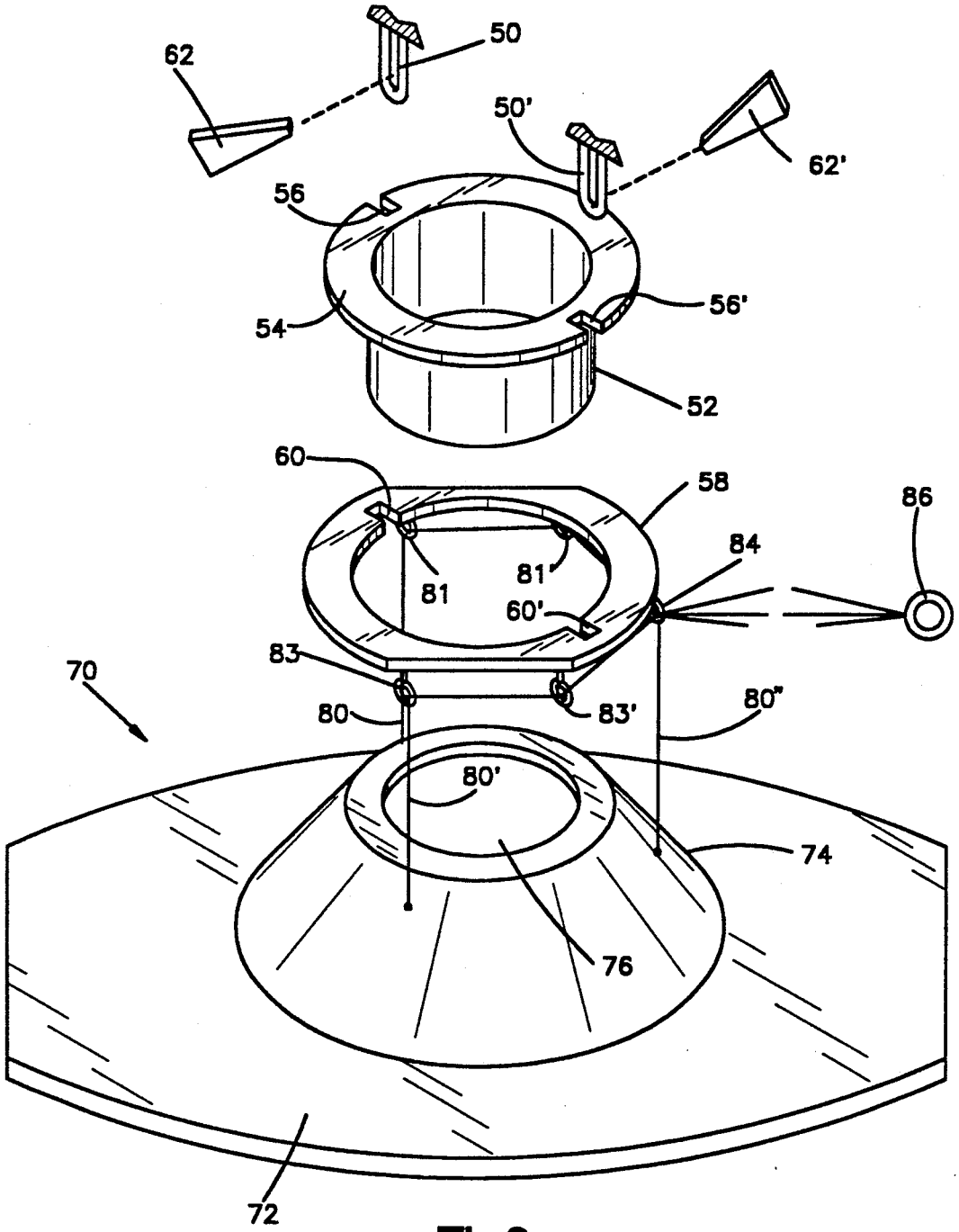
FIG. 3 is an exploded view illustrating details of a portion of the apparatus shown in FIGS. 1 and 2.

Referring to FIGS. 2 and 3, an apertured plate 48 is affixed to the underside of the block member 28 of the nozzle. The aperture in the plate 48 is large enough to permit the above described right and left translational movement of the collector nozzle to initiate and terminate molten metal flow from the tap hole 18 through the collector nozzle. The plate 48 supports two downwardly extending eyelets, one of which is designated 50 in FIG. 2. The function of these eyelets will be discussed shortly.

The shrouding apparatus of the present invention includes a generally cylindrical windscreen portion 52 having an outwardly extending flange 54 at its upper end (see FIG. 3). The flange 54 defines two slots 56, 56', sized such that the eyelets (which are illustrated as 50, 50' in FIG. 3,) can extend through the slots.

A generally annular load ring 58 is provided to hold the windscreen 52 fixed to the bottom of the plate 48 as shown in FIG. 2. The load ring maintains the axis of the windscreen 52 aligned substantially with the axis of the tap hole 18, and of that of the aperture 40.

The load ring 58 defines a plurality of slots, such as 60, 60', cut into its inner periphery, and aligned such that the eyelets 50, 50', will align in registration with the slots 60, 60' when the load ring is raised against the bottom of the plate 48.

To assemble and hold the windscreen in place, the windscreen is raised such that its flange 54 abuts the bottom side of the plate 48, with the slots 56, 56' respectively aligned with each of the eyelets 50, 50'.

The load ring is then placed about the main cylindrical body of the windscreen, and raised until the eyelets 50, 50' extend through the slots 60, 60'. Then, a set of wedges 62, 62' are driven by means of a hammer into the portions of the eyelets 50, 50' which extend downwardly through both the set of slots 56 and set of slots 60 in the windscreen and load ring, respectively. When this is done, the windscreen is fixedly mounted to the bottom of the nozzle assembly 20 with its axis substantially aligned with the tap hole 18 and the aperture 40.

The shrouding apparatus also includes a cover plate 70. The cover plate 70 is a unitary piece of heat resistant material defining an outer brim portion 72, and a central domed portion 74 which in turn defines a central aperture 76. The aperture 76 has a diameter slightly greater than the outside diameter of the windscreen 52, so that the cover plate 70 can be telescopically fitted over the windscreen 52, and forms a rough seal in cooperate with the surface of the windscreen.

Preferably, both the windscreen 52 and the cover plate 70 are made from a low density, highly heat resistant material Tests have shown that one suitable material is a commercially available fibrous ceramic type of substance. Using this substance, the cover plate 70, though having major dimensions of several feet, and a thickness of about one inch, can be made to weigh as little as about 20 pounds. Such light weight enables manual manipulation of the cover plate, as will be described below.

The cover plate 70 is suspended beneath the load ring, in a vertical sliding arrangement with respect to the windscreen, by a flexible line apparatus. The flexible line apparatus includes three wires 80, 80', 80''. Each of the lines is fastened at its lower end to the cover plate 70. Each of the lines extends upwardly through eyelets downwardly extending from the load ring 58. The three lines ultimately pass through a single eyelet 84 and are coupled to a lift ring 86 which is within reach of an operator.

Line 80 extends through eyelets 81, 81' before passing through the eyelet 84. Line 80' extends through eyelets 83, 83', before also passing through the eyelet 84. The lines 80, 80', 80'', eyelets 81, 81', 83, 83' eyelet 84 and lift ring 86 comprise a wire harness and actuating means for supporting and manually lifting the cover plate.

Figure 4:
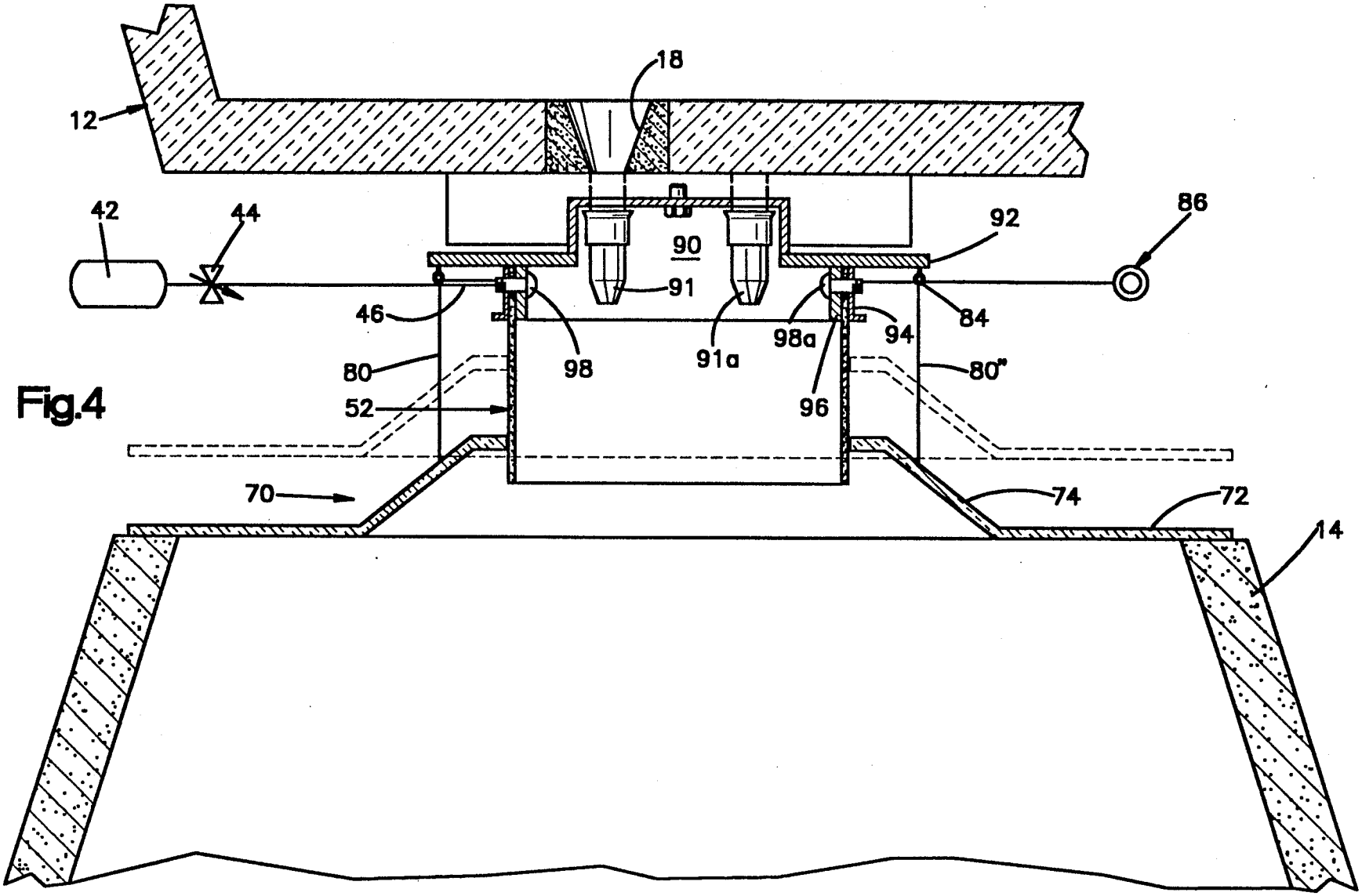
FIG. 4 is an elevational view, taken in cross section, illustrating portions of the apparatus of FIG. 1 showing a different embodiment of the invention.

FIG. 4 illustrates an embodiment of the shrouding apparatus similar to, but slightly different from, that of the embodiment described in connection with FIG. 2. The FIG. 4 embodiment comprises a shrouding apparatus which is compatible for use on a rotary nozzle, rather than on the sliding gate nozzle of FIG. 2.

The rotary nozzle is generally indicated at 90 in FIG. 4. Rotary nozzles are well known in the art.

Briefly, for the benefit of those not intimately conversant with the art, the rotary nozzle, sometimes call a "rotary gate cassette", includes a mechanism (not shown) for rotating dual nozzles 91, 91*a*, so that at least one nozzle is positioned below and aligned with the tap hole 18 of the ladle 12. When a nozzle is positioned below the tap hole, the flow of molten material from the ladle is enabled. The molten material is discharged through the nozzle 91, 91*a* which is aligned with the tap hole and into the ingot mold 14 beneath.

A plate 92 is mounted to the underside of the rotary gate nozzle cassette 90. The plate 92 performs a function similar to that of the load ring 58 described in connection with FIGS. 2 and 3. Attached to the bottom of the plate 92 are two concentric cylindrical cans having vertical axes and surrounding the nozzles 91, 91*a*. An outer can is designated 94 and an inner can is designated 96 in FIG. 4. The two cans 94, 96 define a space between them of a magnitude suitable for accommodating insertion of the walls of the cylindrical windscreen 52. That is, the space between the outer diameter of the inner can 96 and the inner diameter of outer can 94 is approximately equal to the thickness of the wall of the cylindrical windscreen.

A pair of tubular threaded support pipes 98, 98*a* extend through the respective walls of the inner can 96 and the outer can 94. These support pipes cooperate to support the windscreen in a fixed, but removable, relationship with the underside of the rotary gate nozzle assembly 90.

The support pipes 98, 98*a* perform an additional function, i.e., that of providing a portion of the conduit carrying the argon gas into the central region of the nozzle. The inner ends of the support pipes are provided with small diffusers to enhance the even distribution of the argon throughout the interior of the lower portion of the nozzle assembly As shown in FIG. 6, two L-shaped notches 100 are cut into the upper rim 52*a* of the windscreen 52. Each L-shaped notch is suitable for locking engagement with one of the pipes 98, 98*a*. In order to mount the windscreen 92 on the underside of the nozzle assembly, an operator manually aligns the windscreen such that its wall slides into the space defined between the inner and outer cans 96, 94. The windscreen can then be manually lifted until it abuts the underside of the plate 92. When the windscreen has reached this limit of its upward travel, the operator engages each of the notches 100 with a respective one of the support pipes 98, 98*a*. A twisting motion applied to the windscreen causes the windscreen to lock onto the support pipes. To remove the windscreen, after pouring, the operator simply twists the windscreen in the opposite direction, disengaging the support pipes from the L-shaped notches, and lowers the windscreen out of the way.

When the nozzles 91, 91*a* of the rotary nozzle assembly 90 are caused to be rotated, the inner and outer cans 96, 94, as well as the windscreen 52, rotates in unison with the nozzles.

FIG. 7 is a plan view of the underside of the plate 92 as described in FIG. 4. FIG. 7 illustrates the nozzles 91, 91*a* protruding through the center of the plate, and a set of four flexible lines comprising the wire harness, designated 80, 80', 80'', 80'''. The lines are extended through the eyelet 84 and are connected in a ganged relationship with the operator lifting ring 86.

FIG. 5 is a plan view showing the cover plate 70 aligned with the upper rim of an ingot mold 14.

Referring once more to FIG. 1, a top pouring operation employing the present inventive apparatus will now be described. The ladle is first filled with approximately 200 tons of molten steel to be poured into the ingot molds. The ladle is then moved transversely by crane to the first of a succession of ingot molds 14 into which molten steel is to be poured.

During this part of the operation (transit of the ladle) the ring 86 is temporarily engaged on a member (not shown) mounted fixed relative to the ladle, maintaining the cover plate 70 in a position relatively elevated and close to the bottom of the ladle 12, to keep it out of the way and avoid its striking other objects.

When the ladle has been translated to a location such that the cover plate and the ladle tap hole are aligned with the upper opening of a mold 14, the operator, after the molten stream is established by another operator opening the nozzle, lessens the tension on the lines 80, 80', 80'', 80''' by means of the load ring 86. This allows the cover plate 70 to be lowered by gravity until it rests upon and is aligned with the upper rim of the mold 14. The length of the windscreen 52 is sufficient to maintain the telescopic engagement of the windscreen in the central aperture of the cover plate when the cover plate has been lowered to abut the upper rim of the mold.

A flow of inert gas into the shroud and into the ingot mold is maintained.

During the pouring operation, the operator can manually raise the cover plate 70 by adjusting the tension on the wire harness as applied by the lift ring 86, in order to afford the other operator, who is controlling the pouring, a direct view of the pouring operation as it progresses. This enables the other operator to terminate the molten flow by closing the nozzle at a precisely determinable fill level.

The hanging suspension of the cover plate 70 on the wire harness allows tilting of the cover plate about virtually any horizontal axis. This degree of freedom of movement allows the cover plate to assume whatever attitude is necessary to conform most closely to the particular configuration of the upper rim of the ingot mold 14. This is advantageous because often the ingot mold rim is not perfectly level. Additionally, cooled encrusted metal deposits sometimes build up on the upper surface of the rim, giving it a rough or undulating surface or configuration. It is desirable that the cover plate have the maximum degree of flexibility of motion in order to form the best possible seal with the upper rim of the mold. The particular hanging suspension disposition of the cover plate affords this flexibility.

After the cover plate has been lifted into its transport position, and the nozzle is closed, the ladle is translated until its movement positions the cover plate aligned with the upper rim of the next ingot mold to be filled, at which location the ladle is stopped. After the molten flow is re-established, the operator, using the lift ring, relaxes tension on the lines. In this way the cover plate is relowered to effect a seal with the upper rim of this next mold. The pouring operation is then repeated as before.

The ladle holds enough molten steel to fill a succession of several ingot molds. After the last ingot mold of the succession has been filled, and the ladle emptied, the cover plate and windscreen are usually discarded and replaced, due to heat erosion. Due to the light weight of the windscreen and cover plate, this is an easy operation for even a single operator to manually execute. Also, the windscreen and cover plate are relatively inexpensive, and their discard does not result in a substantial increase in the cost of pouring.

In order to remove the cover plate, it is simply detached from the lower ends of the wires 80, 80', 80'', 80''' of the wire harness, by use of conventional releasable fasteners, and a new cover plate is hung from the harness.

Demounting the windscreen from the underside of the nozzle generally amounts to impacting it with a metal rod, which causes the now-brittle windscreen to simply break up and fall away. Portions of the windscreen which adhere between the inner and outer cans are dug out easily with the end of the rod.

A significant advantage of the easy adjustment in elevation of the cover plate, relative to the ladle, is that the ladle itself need never be raised or lowered between mold pouring operations. Rather, the ladle can simply be translated in a horizontal direction, and any vertical adjustment in the interface between the ladle and the mold can be effected by changing the elevation of the light weight cover plate. As can be seen from the foregoing description, a single operator can handle the entire operation of the shrouding apparatus, including removal and replacement of the windscreen and cover plate when needed.

It is to be understood that this specific description is intended as illustrative, rather than exhaustive, of the invention. Those of ordinary skill in the art may be able to make additions or modifications to, or deletions from, the embodiments described in this specific description, without departing from the spirit of the scope of the invention, as set forth in the appended claims.

I claim:

1. Apparatus for shrouding a molten metal stream during a teeming operation involving top pouring of molten metal through a tap hole of a ladle into a mold having a rim defining an upward facing opening, said apparatus comprising:

a) a generally tubular windscreen member affixed to and extending downwardly from the bottom of the ladle, the tubular windscreen member being generally aligned with the tap hole of the ladle;

b) a cover plate adapted for seating on the rim of the mold said cover plate being separable from the mold and defining a generally central aperture for forming a rough seal with the outer surface of the windscreen member and with the rim of said mold when the windscreen member extends through said aperture and said cover plate is seated upon the upper rim of said mold, and c) flexible line means for supporting the cover plate in an aligned telescopic relation with the windscreen member, said flexible line means supporting said cover plate for compliant tilting movement about substantially all horizontal axes.

2. The apparatus of claim 1, wherein:

said line means comprises a wire harness connected to the cover plate.

3. The apparatus of claim 2, wherein:

said flexible line means comprises a ganged lift line coupled to said harness for changing elevation of said cover plate relative to said ladle in response to changes in the tension applied to said lift line.

4. The apparatus of claim 2, further comprising:

a load ring coupled to and located above said harness, and means for supporting said load ring beneath said ladle.

5. The apparatus of claim 1, wherein:

said cover plate comprises a fibrous ceramic material.

6. The apparatus of claim 5, wherein:

said windscreen member comprises a fibrous ceramic material.

7. Apparatus for shrouding molten metal during a teeming operation including top pouring of molten metal from a vessel into a mold having an upper rim defining an upward facing opening, said apparatus comprising:

a) a cover plate defining an aperture;

b) flexible line means coupled between said cover plate and the vessel for suspending said cover plate in a location beneath the vessel such that molten metal, when released from the vessel, passes through said aperture of said cover plate, said flexible line means suspending said cover plate for facilitating compliant tilting movement of said cover plate about substantially all horizontal axes.

8. The apparatus of claim 7, wherein:

said cover plate is configured to substantially cover the opening of the mold.

9. The apparatus of claim 7, wherein:

said flexible line means comprises a wire harness.

10. The apparatus of claim 7, wherein:

said flexible line means comprises means for adjusting elevation of said cover plate relative to said vessel.

11. The apparatus of claim 7, wherein:

said cover plate comprises a fibrous ceramic material.

12. Apparatus for shrouding molten metal during a teeming operation including top pouring of molten metal from a vessel into an open-top mold defining an upper rim, said apparatus comprising:

a) a cover plate suitably sized for gravity seating on said rim and for substantially covering the open top of the mold when said cover plate is seated upon said rim and defining an opening for admitting a stream of molten metal from the vessel into said mold, said cover plate comprising a fibrous ceramic material; and, b) means for supporting said cover plate below said vessel for compliant tilting motion about substantially all horizontal axes.

13. Apparatus for shrouding a top pouring operation wherein molten metal is poured from a vessel into a mold having an upwardly facing opening defined by a rim, said apparatus comprising:

a) said vessel defining a tap hole in its bottom;

b) a nozzle assembly mounted on the outside bottom surface of the vessel and being adapted to controllably initiate and terminate molten metal flow from the vessel;

c) a plurality of eyelets extending downwardly from said nozzle assembly;

d) a windscreen member configured generally as a cylinder with an outwardly facing flange at its top, said flange defining slots registrable respectively with each of said eyelets and sized for the eyelets to pass through;

e) an annular load ring adapted to be slidably fitted about the outside surface of said cylindrical windscreen member, said load ring having slots registrable with said eyelets and sized for said eyelets to pass through, said load ring also bearing a plurality of other eyelets;

f) wedge means for securing said windscreen member flange and said load ring to the bottom of the nozzle assembly;

g) a cover plate defining an aperture sized to fit around the windscreen member and form a rough seal with the outer wall thereof;

h) a wire harness comprising a plurality of wires coupled to said cover plate and extending through said other eyelets, said wires all passing through a final of said other eyelets in a ganged configuration, such that adjusting the tension on the ganged wires correspondingly adjusts the elevation of said cover plate with respect to said vessel.

14. An improvement in an apparatus for shrouding a molten metal stream during a top pouring of molten metal through a tap hole of a ladle into a mold, the apparatus including a sliding gate nozzle operative in connection with the tap hole to regulate discharge of molten material from said ladle through said tap hole and said nozzle, the nozzle including a collector nozzle member means for supporting the collector nozzle member for sliding movement into and out of alignment with said tap hole, and a cylindrical sleeve extending about the collector nozzle, the improvement comprising:

means for introducing an inert gas under pressure into the region between the collector nozzle member and the sleeve to inhibit aspiration of air into said region.

15. An improvement in apparatus for shrouding a molten stream of metal during a top pouring operation of a mold by discharging molten metal by gravity from a ladle through a tap hole in the ladle into the mold, the apparatus further including a rotary gate nozzle mounted beneath the ladle in the region of the tap hole for regulating flow of molten material through the tap hole by rotational movement of at least a portion of said rotary gate nozzle, said improvement comprising:

a) larger and smaller tubular cylindrical members concentrically mounted beneath said nozzle and having differing diameters such that a space is defined within the inside diameter of the larger tube member and the outside diameter of the smaller tube member;

b) at least one support pipe member extending from the exterior of the larger of said tube members to the interior of the smaller of said tube members c) means for providing for flow of an inert gas through said support pipe member into the interior of the smaller of said tube members, and d) a cylindrical windscreen member adapted for fitting coaxially between said larger and smaller tubular members and defining a notch for engaging said support pipe member for supporting said windscreen member mounted below said rotary gate nozzle.

16. Apparatus for shrouding a top pouring operation wherein molten metal is poured from a vessel into a mold having an upwardly facing opening defined by a rim, said apparatus comprising:

a) said vessel defining a tap hole in its bottom;

b) a nozzle assembly mounted on the outside bottom surface of the vessel and being adapted to controllably initiate and terminate molten metal flow from the vessel;

c) a plurality of eyelets extending downwardly from said nozzle assembly;

d) a windscreen member configured generally as a cylinder with an outwardly facing flange at its top, said flange defining slots registrable respectively with each of said eyelets and sized for the eyelets to pass through;

e) an annular load ring adapted to be slidably fitted about the outside surface of said cylindrical windscreen member, said load ring having slots registerable with said eyelets and sized for said eyelets to pass through, said load ring also bearing a plurality of other eyelets;

f) wedge means for securing said windscreen member flange and said load ring to the bottom of the nozzle assembly;

g) a cover plate defining an aperture sized to fit around the windscreen member and form a rough seal with the outer wall thereof;

h) a wire harness comprising a plurality of wires connected to said cover plate and extending through said other eyelets, said wires all passing through a final of said other eyelets in a ganged configuration, such that adjusting the tension on the ganged wires correspondingly adjusts the elevation of said cover plate with respect to said vessel, and i) at least one of said windscreen member and said cover plate being made of a fibrous ceramic heat resistant low density material.

* * * * *